United States Patent [19]

Tsukiyama et al.

[11] Patent Number: 4,662,182

[45] Date of Patent: May 5, 1987

[54] ICE STORAGE DETECTOR FOR AN AUGER TYPE ICE PRODUCT MAKING DEVICE

[75] Inventors: Yasumitsu Tsukiyama, Toyoake; Yoshikazu Kito, Oobu; Susumu Tatematsu, Nagoya, all of Japan

[73] Assignee: Hoshizaki Electric Co., Ltd., Toyoake, Japan

[21] Appl. No.: 803,653

[22] Filed: Nov. 29, 1985

[30] Foreign Application Priority Data

Dec. 4, 1984 [JP] Japan ..... 59-183238[U]

[51] Int. Cl.[4] ..... F25C 5/18

[52] U.S. Cl. ..... 62/137; 62/344; 200/61.21; 340/617; 414/294

[58] Field of Search ..... 62/137, 344; 340/612, 340/617; 200/61.2, 61.21; 414/294, 295

[56] References Cited

U.S. PATENT DOCUMENTS

| | | | |
|---|---|---|---|
| 3,192,734 | 7/1965 | Swanson | 62/137 |
| 3,685,356 | 8/1972 | Zimmerman | 200/61.21 X |
| 3,931,911 | 1/1976 | Kohl | 200/61.21 X |

FOREIGN PATENT DOCUMENTS

| | | | |
|---|---|---|---|
| 24629 | 5/1919 | Denmark | 200/61.21 |
| 131161 | 10/1979 | Japan | 62/137 |

*Primary Examiner*—William E. Tapolcai

*Attorney, Agent, or Firm*—Wenderoth, Lind & Ponack

[57] ABSTRACT

An ice product storage detector which instantaneously detects when the ice products have filled the reservoir to its full capacity or when the amount of ice product in storage has decreased. The ice product storage detector includes a proximity switch provided on a barrier plate of a non-magnetizable material, the barrier plate being provided on the lower part of a base portion of the main body of the auger type ice making device, an ice storage detector plate rotatably mounted about a shaft in the ice product reservoir in positional registration with the proximity switch and which is formed of a low heat capacity and low thermo-conductive material, a pair of inclined plate sections provided on an ice product receiving portion of the ice product storage detector plate, and an auxiliary detector plate formed of a magnetizable material and provided on the ice product storage detector plate so as to be normally parallel to the detective surface of the proximity switch. When the ice product storage detector plate is turned about the shaft under the effect of the ice products falling from the main body contacting with the ice product receiving portion of the ice product storage detector plate, the auxiliary detector plate is pivoted away from the position of mating with a detecting surface of the proximity switch to detect the ice product storage.

8 Claims, 7 Drawing Figures

ICE STORAGE DETECTOR FOR AN AUGER TYPE ICE PRODUCT MAKING DEVICE

BACKGROUND OF THE INVENTION

This invention relates to an ice storage detector for an auger type ice product making device. More particularly, it relates to an improvement whereby such detector can instantaneously and positively detect whether a reservoir is full of lightweight flake ice or if the ice is being used even at low ambient temperatures.

Various ice storage detecting devices are known in the art for use with the auger type ice making devices mounted on the ice reservoir. Typical of these are a thermostatic storage detecting system adapted to detect the ice temperature and a mechanical storage detecting system adapted to detect the movement of the ice products such as that shown in Japanese Laid-open Patent Publication No. 57-184486 and shown herein in FIG. 1 and that shown herein in FIG. 2.

In the system shown in FIG. 1, an ice product storage switch 2 is enclosed in a base plate 1*a* of the ice storage detector 1, said base plate 1*a* being secured to a top cover 4 of an ice reservoir 3. An ice storage detector plate 5 mounted to a shank 1*b* for rotation in the direction of the arrow is held at the lower extremity of the base plate 1*a* and is made up of a connecting lever 5*a* and an ice detecting portion 5*b*.

The above system has been developed for use with batch type automatic ice cube makers where the cube ice has a larger unit weight, slides easily and where a large amount of ice can be stored in the ice reservoir at one time. Since considerable force is applied to an ice receiving portion 5*c* in the ice detector 5*b* of the ice storage detector 1, the ice detector plate 5 is positively turned to cause actuation of the lever 2*a* associated with an ice storage switch 2 thereby controlling the switch 2.

In the ice storage detector 1 shown in FIG. 2, a barrier plate 4*a* formed of a nonmagnetic material is provided at the top cover 4 of the ice reservoir 3, and a proximity switch 2 acting as an ice storage switch, is provided on the upper surface of the barrier plate 4*a*. A base plate 1*a* adapted to support the ice storage detector plate 5 for rotation in the direction of the arrow about a shaft 1*b* is removably attached to the lower surface of the plate 4*a*. To the upper end of the ice storage detector plate 5 and in opposition to the switch 2 an auxiliary plate 6 formed of a magnetic material is mounted.

The above described ice detector 1 is used in conjunction with a specified type of auger ice product making device in which the ice storage detector 1 can be mounted in the proximity of an outlet duct 7, and mainly in conjunction with an auger ice making device having an attached ice product reservoir. When the ice products fill the reservoir 3 close to its full capacity, the ice products discharged out of the discharge port 7 act directly on the ice storage detector plate 5 so that a large force is applied to plate 5 and thereby the proximity switch 2 is positively actuated.

In a conventional auger type ice making device in which the main body of the device is mounted on the ice reservoir, when it is supposed that the small lightweight ice, such as a flake ice, products that are irregular in shape and are less likely to slip are dropped into the reservoir to be gradually heaped in a conical pattern, the ice products start to contact with the lower portion of the detector plate of, for example, the ice product storage detector unit shown in FIGS. 1 and 2.

With a gradual increase in the contact surface between the ice and the detector plate, the ice flakes tend to be heaped along the contact surface of the ice product detector plate with the result that an ice load sufficient to actuate the ice product detector plate is not reached. The result is that the ice product storage detector is not actuated when the ice reservoir is filled to its full capacity so that the ice product making operation further continues to cause a serious accident or malfunction in the ice making section of the device.

Thus, conventional systems, especially the thermostatic ice storage detector above, are inhibited by low ambient temperatures so that positive ice storage detection can not be achieved when the ice is of such a nature that it is only stored gradually and its force for operating the ice product detector plate is small.

SUMMARY OF THE INVENTION

The present invention provides means highly effective to obviate the above described deficiencies of the prior art system.

The ice storage detector for an auger type ice product making device of the present invention includes: a proximity switch provided on a barrier plate of nonmagnetic material, said barrier plate being provided at the upper part of an ice product reservoir, an ice storage detector device provided in the ice product reservoir in positional registration with said proximity switch, an ice product storage detector plate formed of low heat capacity and low thermo-conductive material, said detector plate being arranged in the ice product storage detector device and pivotably carried within the ice product reservoir by a shaft, a pair of inclined plate sections provided on an ice product receiving portion of the ice product storage detector plate, and an auxiliary detector plate formed of a magnetic material and provided on said ice product storage detector plate so as to be normally parallel to the detecting surface of the proximity switch, said ice product storage detector plate being almost at right angle to the inclined upper surface of the cone shape of ice products stored in the reservoir, and further, this position of the ice product storage detector plate being maintained by the overall weight distribution of said ice product storage detector plate.

In the above construction, even when the ice product reservoir is filled to the brim and the contact surface area between the ice product storage detector plate and the ice products gradually increases, the ice products are trapped by the inclined plate sections provided at both sides of the ice product receiving portion, so that the ice products which accumulate in the ice product reservoir do not fall around and heap up at the back side of the detector plate. Since the storage detector plate gradually inclines under small loads and can positively detect when the reservoir is completely filled up, the device can be operated without regard to the ambient temperature, and the mating relation between the auxiliary detector plate and the proximity switch is released as soon as the storage detector plate pivots to positively detect the termination of ice charging. As the amount of ice products stored decreases through consumption, the ice storage detector plate returns instantly to its starting balanced position under its own weight distribution without the help of any specific restoration means so that a positive ice product making operation is assured despite low ambient temperatures.

BRIEF DESCRIPTION OF THE DRAWINGS

FIGS. 1 and 2 show a prior-art device, wherein

FIG. 2 is a side view, shown partially in section, of the ice reservoir and the ice product storage detector unit.

FIGS. 3 and 4 show the ice product storage detector to be used in conjunction with the auger type ice making device according to the present invention, wherein FIG. 3 is a sectional view of the ice product storage detector.

DETAILED DESCRIPTION OF THE PREFERRED EMBODIMENT

Figure 1A:
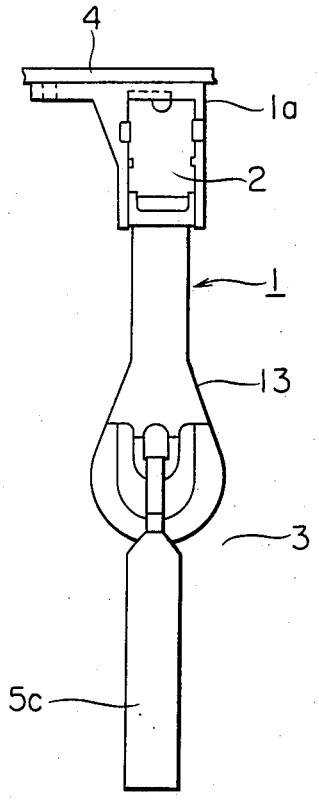
FIG. 1(A) (PRIOR ART)
FIG. 1A is a front view of an ice product storage detector.
Figure 1B:
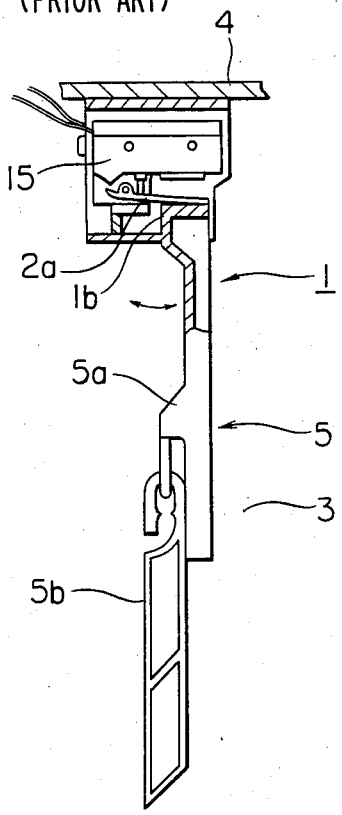
FIG. 1(B) (PRIOR ART)
FIG. 1B is a right-side view, shown partially in section, of the ice product detector shown in FIG. 1A.
Figure 2:
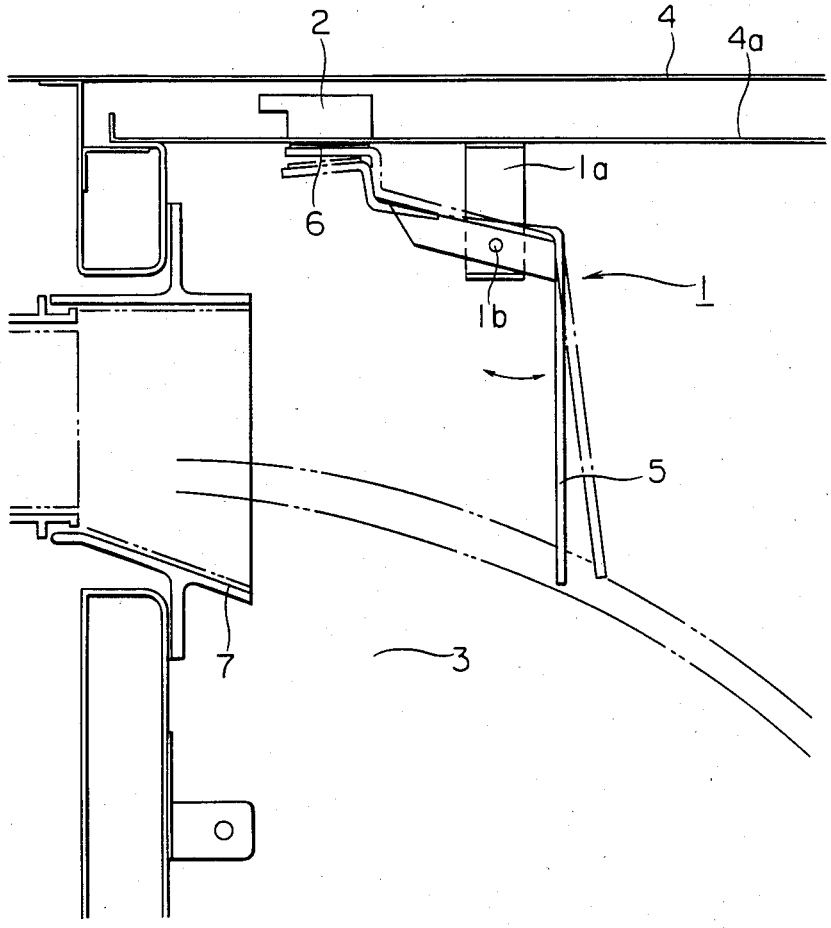
FIG. 2 (PRIOR ART)
Figure 3:
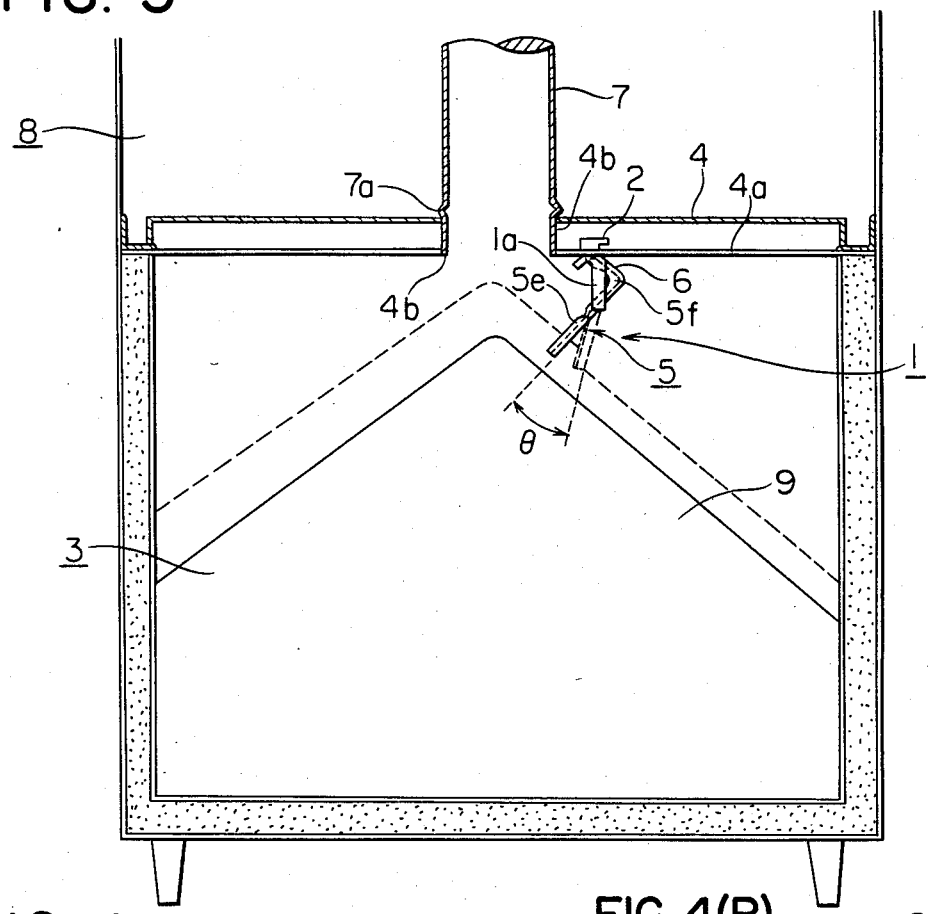
Figure 4A:
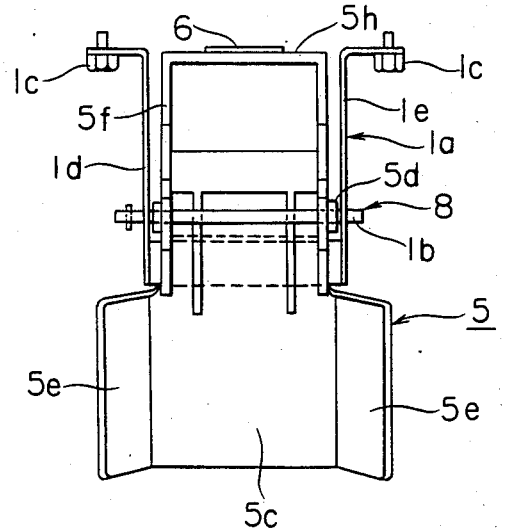
FIG. 4A is an enlarged front view showing the essential parts of FIG. 3.
Figure 4B:
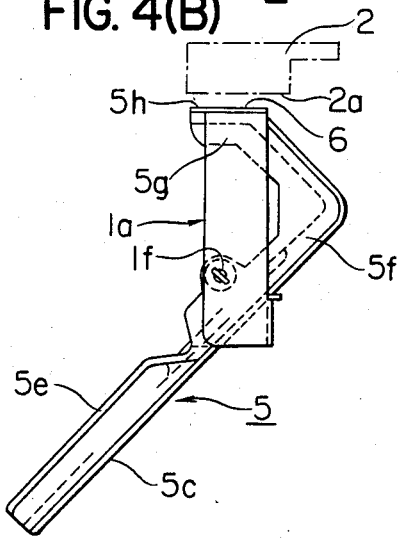
FIG. 4B is a side view of FIG. 4A.
Figure 5:
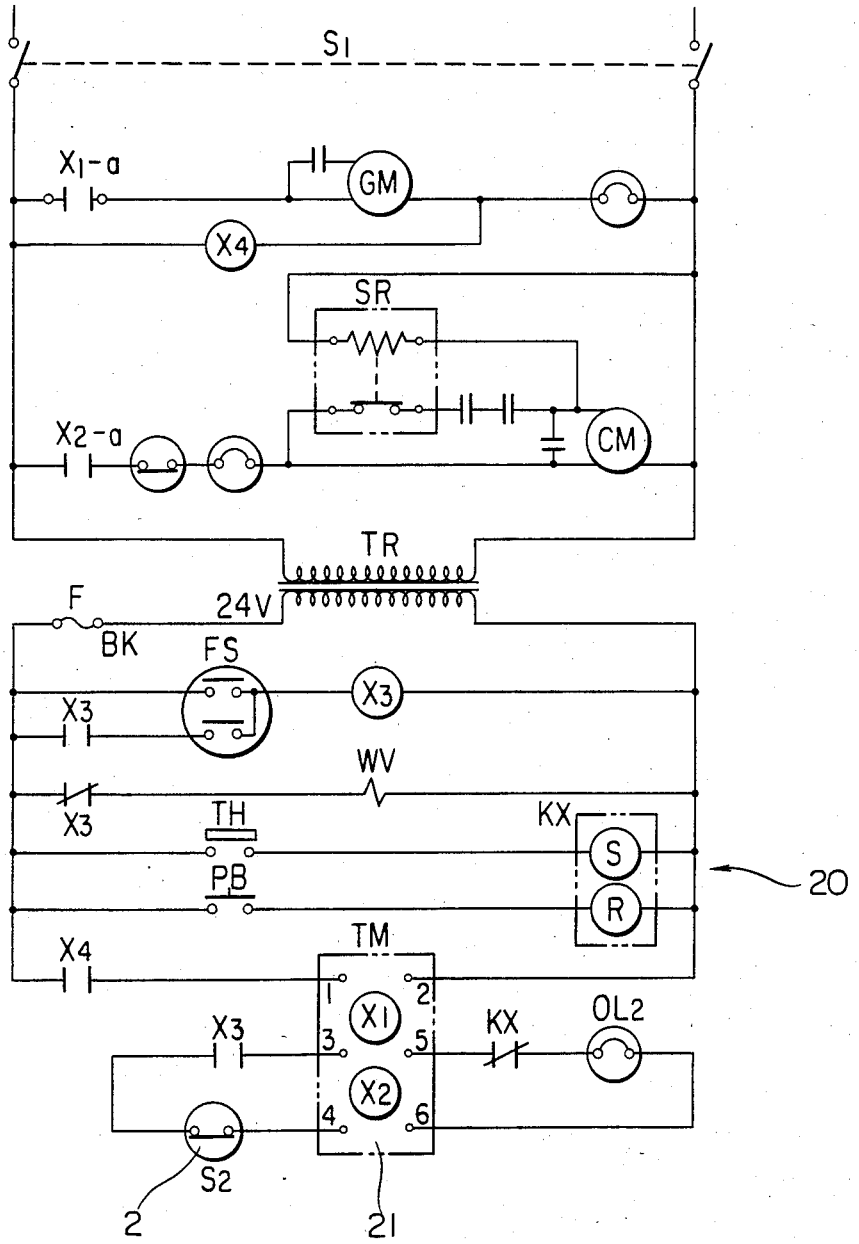
FIG. 5 shows a circuit diagram for showing the operation of an ice product device of the present invention.

An ice product storage detector for use with an auger type ice making device will be hereafter explained by referring especially to FIGS. 3, 4A and 4B, wherein the components that are the same as or similar to those shown in FIGS. 1 and 2 are indicated by the same numerals.

The auger type ice making device according the invention has its main body 8 in which ice formed on the inner wall surface of a cylindrical freezer casing is scraped off to form flaked or particulate ice products is fixedly mounted to the upper part of the ice product reservoir 3. To the lower part of the top cover 4 of the ice product reservoir 3, corresponding to the bottom of the main body 8, is affixed a barrier plate 4*a* of a non-magnetic material. The top cover 4 and the barrier plate 4*a* are formed with through-holes 4*b* in which is fitted an ice discharge duct 7 of the main body 8 having a peripheral annular projection 7*a* engaged to snap fit in the opening 4*b*.

A proximity switch 2 for detecting the storage of ice products is mounted on the upper surface of the barrier plate 4*a*. A base portion 1*a* having a shaft 1*b* and being a part of the ice product storage detector 1 is securely mounted by bolts 1*c* to the portion of the lower surface of the barrier plate 4*a* at a position corresponding to the proximity switch 2.

The base portion 1*a* has side plates 1*d*, 1*e* through which is passed the shaft 1*b* carrying a substantially L-shaped ice detector plate 5 which pivots in the direction of the arrow, the shaft 1*b* is passed through an opening 1*f* in the side plates 1*d*, 1*e* and an opening 5*d* in the detector plate 5.

The detector plate 5 is formed with a lower ice receiving portion 5*c* formed in turn with a pair of inclined plate sections 5*e* for positively holding the ice products discharged from the discharge duct 7 even when the ice products have been filled to the brim. The upper part 5*f* of the detector plate 5 is in the form of the letter L. The ice product storage detector plate 5 itself is formed of a low heat capacity and low thermo-conductive material such as synthetic resin. The overall weight distribution of the plate 5 is designed in such a manner that, with the plate 5 carried for rotation by the shaft 1*b*, that is, in the absence of any external force applied to the plate 5, the plate can be maintained stationary about the shaft 1*b* in the state shown in FIG. 4B. The ice storage detector device 1 is essentially made up of the ice product storage detector plate 5, the base section 1*a* and the auxiliary detector plate 6, which can be formed of a magnetic material. In addition, in the absence of any external force applied to the ice product storage detector plate 5, the foremost part 5*g* of the ice storage detector plate 5 has its upper surface 5*h* substantially parallel to a lower surface 2*a* of the proximity switch 2. Therefore, the ice product storage detector plate 5 is stabilized at a standstill so that in the absence of the external forces applied to the detector plate 5, that is, when the ice product does not fill the reservoir 3 to its full capacity, the auxiliary detector plate 6 annexed to the foremost part 5*g* of the plate 5 is substantially at right angles to the inclined surface of the ice products 9 heaped in a cone shape in the reservoir 3. In this manner, the auxiliary plate 6 is in operational register with the proximity switch 2 which continues to transmit a positive output signal to continue an ice product storage operation. When the ice products fill the reservoir to its full capacity, the ice products abut on the ice receiving portion 5*c* and the detector plate 5 is turned gradually about the shaft 1*b* as its center to release the mating operational relationship between the auxiliary detector plate 6 and the switch 2. The output signal from the switch 2 is now turned off to indicate that the reservoir 3 has been filled to its full capacity. Further, as the stored amount of the ice product 9 is gradually increased, the ice products 9 abut the ice receiving portion 5*c* and the detector plate 5 then pivots, whereby the output signal of said proximity switch 2 is changed to an OFF condition. A timer (not shown) of a timer board section 21 of a control circuit 20 starts to count for 60 seconds in order to eliminate the repetitive-switching ON and OFF of a compressor (CM) in response to the repetitive-switching ON and OFF operation, such as in chattering, of said proximity switch 2. Said control circuit 20 determines that said ice storage reservoir 3 is full and changes the contacts $X_1$-a and $X_2$-a of keeping relays $X_1$ and $X_2$ into an OFF condition, so that the ice making cycle is terminated by turning off a geared motor (GM) and the compressor (CM).

The ice product storage detector for the auger type ice making device operates as follows.

With the main switch turned on, the ice products 9 prepared in the body member 8 travel through the discharge duct 7 to descend into the ice reservoir 3 where they are heaped in a cone shape. As the stored amount of the ice product 9 is gradually increased from the level position represented by the solid outline in FIG. 3 to the dotted-line upper level position in FIG. 3, the ice products 9 are received by the inclined plate sections 5*e* of the ice receiving portion 5*c* of the detector plate 5, so that the ice products 9 are prevented from going around to the reverse sides of the receiving portion 5. With a minor quantity of ice product 9 resting on the surface of the receiving portion 5*c*, the detector plate 5 is gradually pivoted from the normal, non-ice detecting position represented by the solid lines to the dotted-line ice detecting position in FIG. 3. The foremost part 5*g* is also turned through an angle $\theta$ from the solid-line position to the dotted-line position, where the foremost part 5*g* is stopped from making any further rotation. This causes the positional registration between the auxiliary detector plate 6 and the detector surface 2*a* of the switch 2 to be released, the output signals from the switch 2 being turned off to indicate the end of ice storage, the ice making operation of the main body 8 of the auger type ice product making device is terminated when OFF condition of said output signal of said proximity switch 2 is maintained during 60 seconds.

When the amount of stored ice products is reduced as from consumption, the ice products no longer abut on the detector plate 5. Since the plate 5 is no longer urged by the abutting ice products, the plate 5 naturally returns from the dotted line position to the solid-line position due to the effect of its overall weight distribution. The auxiliary detector plate 6 also returns to its original position in operative register with the detector surface 2*a* of the switch so that the body main 8 of the ice making device is again driven in operation by the output signals from the switch 2 to start the supply of the ice products into the reservoir 3.

EFFECT OF THE INVENTION

From the foregoing it can be seen that the present invention provides an ice storage detecting unit for an auger type ice product making device wherein the overall weight distribution of the ice storage detector plate is so designed that the auxiliary detecting plate annexed to the ice storage detector plate is parallel to the detection surface of the proximity switch when the ice storage detector plate is suspended freely from its supporting structure. In this manner, the detection system operates positively with ice products that are irregularly shaped, light in weight and do not slip easily and which are unable to act with sufficient force on the ice storage detector plate. Also, since the ice products can be positively trapped by the inclined plate sections, there is no risk that the ice products will go around behind the sides of the ice storage detector plate to cause chattering of the storage detector plate thus assuring positive ice storage detection.

In addition, since the electrical signals indicating ice storage are issued on the basis of direct contact with the ice products, efficient operation can be continued as the ice product making operation can be continued despite a fall in the ambient temperature.

What we claim is:

1. An ice storage detector for use in an ice product making machine including an ice making mechanism, and an ice product reservoir in which ice products produced by the ice making mechanism are heaped in a pile of ice products having a conical configuration, said ice storage detector comprising:

(a) an ice product detection plate pivotally mounted in the ice product reservoir, said ice product detection plate comprising an ice receiving portion having opposite sides, and a pair of inclined portions each of which extends from a respective one of said opposite sides of said ice receiving portion, said pair of inclined portions facing toward the top of the ice product pile and each of said pair of inclined portions being inclined at an angle to said ice receiving portion;

(b) means, including a substantially horizontal shaft, for supporting said detection plate in said ice product reservoir for pivotal movement about said horizontal shaft;

(c) switch means disposed above said detection plate; and (d) said detection plate being pivotable about said horizontal shaft between a normal, non-ice detecting position, and an ice detecting position at which said ice receiving portion is displaced in a direction away from the top of the ice product pile, said detection plate including means for causing said switch means to generate an ice detecting signal when said detection plate is in said ice detecting position.

2. The detector according to claim 1, wherein said ice product making machine is an auger type ice making machine producing particulate ice.

3. The detector according to claim 1, wherein said ice product making machine is an auger type ice making machine producing flaked ice.

4. The detector according to claim 1, wherein said switch means is a proximity switch and said detection plate is provided at the top thereof with an auxiliary detection plate made of a magnetic material, said auxiliary detection plate being substantially parallel to said proximity switch when said detection plate is in said normal position.

5. The ice storage detector according to claim 1, wherein the overall weight distribution of said detection plate is such that said ice receiving portion of said detection plate in said normal position is substantially at a right angle with respect to the conical surface of said conical configuration of ice products.

6. The ice storage detector according to claim 1, wherein said switch means comprises a proximity switch, said proximity switch being mounted on a non-magnetic barrier plate disposed above said ice product detection plate.

7. The ice storage detector according to claim 1, wherein said detector plate is L-shaped, said ice receiving portion being the lower part of said L-shaped detector plate and said horizontal shaft extending through an opening in each of said pair of inclined portions extending from said ice receiving portion.

8. The ice storage detector according to claim 1, wherein said ice product reservoir includes an opening through which the ice products are discharged into the ice product reservoir, the ice receiving portion of the detection plate being closer to said opening in said ice product reservoir when said detection plate is in said normal, non-ice detecting position than when said detection plate is in said ice-detecting position.

* * * * *